US007553218B2

(12) United States Patent
Morita

(10) Patent No.: US 7,553,218 B2
(45) Date of Patent: Jun. 30, 2009

(54) MULTI-BLADED RAZOR CARTRIDGE SHARPENER WITH ALOE VERA GEL LUBRICANT

(76) Inventor: Andy Morita, 22745 Kentfield St., Grand Terrace, CA (US) 92313

( * ) Notice: Subject to any disclaimer, the term of this patent is extended or adjusted under 35 U.S.C. 154(b) by 0 days.

(21) Appl. No.: 12/005,447

(22) Filed: Dec. 28, 2007

(65) Prior Publication Data

US 2008/0108285 A1 May 8, 2008

(51) Int. Cl.
*B24B 23/00* (2006.01)
*B24B 3/48* (2006.01)

(52) U.S. Cl. ..... 451/349; 451/556; 76/82

(58) Field of Classification Search ..... 451/556, 451/552, 555, 453, 349, 344; 76/82, DIG. 8, 76/DIG. 9, 81.3; 30/35
See application file for complete search history.

(56) References Cited

U.S. PATENT DOCUMENTS

| | | | | |
|---|---|---|---|---|
| 1,471,713 | A | | 10/1923 | Stadniczek |
| 1,540,078 | A | | 6/1925 | Long |
| 1,588,322 | A | | 6/1926 | McAdoo |
| 1,594,246 | A | | 7/1926 | Dechert |
| 1,787,372 | A | | 12/1930 | Hehnly |
| 1,861,683 | A | | 6/1932 | Branch |
| 2,094,722 | A | | 10/1937 | Sandford |
| 2,458,257 | A | * | 1/1949 | Donovan ..... 451/321 |
| 5,036,731 | A | | 8/1991 | Fletcher |
| 5,558,572 | A | | 9/1996 | Fletcher |
| 5,785,586 | A | | 7/1998 | Delsignore |
| 6,030,281 | A | * | 2/2000 | Cozzini et al. ..... 451/320 |
| 6,062,970 | A | | 5/2000 | Back |
| 6,251,003 | B1 | | 6/2001 | LeVine |
| 2003/0170198 | A1 | | 9/2003 | Williams |
| 2004/0235692 | A1 | | 11/2004 | Pfeffer Slobodinsky |

* cited by examiner

*Primary Examiner*—Robert Rose

(57) ABSTRACT

Apparatus for sharpening and or honing a multi-bladed razor cartridge including a sharpening member, a housing to secure the sharpening member. An aloe Vera or soap solution dispenser provides a lubricant to the sharpening member to lubricate the razor and a housing to limit the travel of the razor on the sharpening member. The sharpening and or honing member is made of a mirrored plate glass secured in a channel within the housing.

19 Claims, 4 Drawing Sheets

MULTI-BLADED RAZOR CARTRIDGE SHARPENER WITH ALOE VERA GEL LUBRICANT

CROSS REFERENCE TO RELATED APPLICATION

This application claims priority to application Ser. No. 11/440,393 filed on May 25, 2006 now abandoned which claims priority to application Ser. No. 10/985,386 filed Nov. 9, 2004

DESCRIPTION

1. Field of the Invention

The present invention relates to apparatus for sharpening a multi-bladed cartridge razor. More specifically, the invention relates to apparatus for use with to sharpen or hone a multi-bladed sharpening razor where multiple blades are retained in a single shaving cartridge. The multi-bladed shaving razor is used for shaving the face, legs, underarm, and other areas of a body where unwanted hair is present. A lubricant comprising of aloe Vera gel is utilized to improve the honing process of the blades.

2. Background of the Invention

Most safety razors are typically used for shaving the face and other hairy regions of the human body. The razor, consist of a metal and/or plastic handle attached to a multi-bladed cartridge razor head. Generally a multi-bladed razor cartridge is capable of not more than 5 to 10 close shaves before the shaving edges becomes dull and the user must dispose of the cartridge. There is a need for quick and simple means for honing or re-sharpening the blades in order to extend their useful life.

U.S. Pat. No. 1,540,078 issued May 23, 1924 to W. R. Long discloses a sharpener for a single flat razor blade. With this invention the user places a single blade in the sharpener, and slides the blade over a sharpening surface that sharpens the blade. While this invention sharpens a single blade, it is not intended for sharpening multiple blades, a cartridge of blades and it abrades the blade surface in addition to just removing oxidation from the edge of the blade.

U.S. Pat. No. 1,588,322 issued Apr. 4, 1924 to T. McAdoo discloses a sharpener for a single flat razor blade. With this invention the user places a single blade in the sharpener, and slides the blade over a sharpening surface that sharpens the blade. While this invention sharpens a single blade, it is not intended for sharpening multiple blades, a cartridge of blades and it abrades the blade surface in addition to just removing oxidation from the edge of the blade.

U.S. Pat. No. 1,594,246 issued Aug. 28, 1925 to H. W. Dechert discloses a scraper sharpener. With this invention the user places a scraper blade in the sharpener, and slides the blade over the surface of a file to sharpen the edge of the scraper. While this invention sharpens scraper, it is not intended for sharpening multiple blades, a cartridge of blades and it abrades the blade surface in addition to just removing oxidation from the edge of the scraper.

U.S. Pat. No. 2,458,257 issued Jun. 25, 1946 to A. E. Donovan discloses a holder and sharpener for a single flat razor blade. With this invention the user places a single blade in the holder/sharpener, and slides the blade over a sharpening surface that sharpens the blade. While this invention sharpens a single blade, it is not intended for sharpening multiple blades, a cartridge of blades and it abrades the blade surface in addition to just removing oxidation from the edge of the blade.

U.S. Pat. No. 5,036,731 issued Aug. 6, 1991 to Fletcher discloses a Razor Sharpening Device that sharpens a single razor blade. With this invention the user places a single blade in the sharpener, and slides the blade over a honing member that sharpens the blade. While this invention sharpens a single blade, it is not intended for sharpening multiple blades, or a cartridge of blades.

Published US Patent application 2003/0170198 from Williams published Sep. 11, 2003 discloses a shaving gel using a number of ingredients including aloe Vera gel for shaving. While this published application discloses the use of aloe Vera gel as a lubricant for shaving there is no disclosure where the shaving gel is utilized to sharpen the shaving razor.

The prior art discloses examples of apparatus for sharpening blades of a razor, but none providing the combination of features disclosed and claimed herein.

BRIEF SUMMARY OF THE INVENTION

One of the objects of this invention is to provide a new and improved sharpening device for sharpening the cutting edges of a multi-bladed cartridge razor. Other objects of this invention are to provide apparatus that can rapidly sharpen razor blades mounted in a cartridge, which have no moving parts, is compact and durable.

Razor blades in general become dull when oxidation occurs to the cutting edge. When the oxidation is removed, the cutting edge can be restored or maintained by first applying a soap or aloe Vera film onto the sharpening surface and secondly removing the oxidation by sliding the cutting blade edge along a honing or sharpening surface. When only the oxidation is removed, the cutting blade edge can be maintained as long as the razor blade edge is not altered.

It is another object of this invention to utilize aloe Vera gel to lubricate the glass sharpening surface to remove oxidation from the edge of the razor. The aloe Vera gel allows the blade to move along the surface of the glass and not bind. The aloe Vera further creates a slurry that spreads along the blade to provide even sharpening or honing of the blade.

In accordance with the present invention, an apparatus is proposed for sharpening the cutting edges of a multi-bladed cartridge razor mounted within a shaving head that is attached to a handle. A liquid aloe Vera or soap-dispensing device provides a slurry solution to the sharpening surface to provide lubrication. The sharpening apparatus comprises a housing that holds a sharpening element. The soap or aloe Vera dispensing apparatus is a plastic housing with a dispensing end with a cap. The housing includes a substantially elongated flat member. The housing has grooved sidewalls, and an attachment mechanism located along the opposite edges of the bottom member.

It is another object of the invention to keep the glass or mirror surface exposed to allow the person shaving to utilize the surface to view their reflection while shaving. This give the invention a dual purpose of both providing a sharpening surface and a viewing surface.

In one embodiment of the invention, a wire or string is attached to eyelet screws to provide a means to store the invention on a showerhead collar or on a wall-mounting bracket.

DETAILED DESCRIPTION

Figure 1:
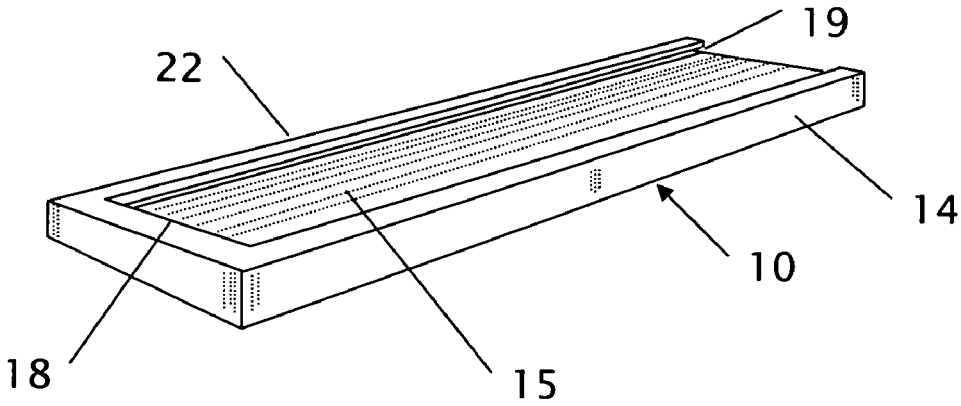
FIG. 1 is an isometric view of the multi-blade sharpening apparatus.
Figure 2:
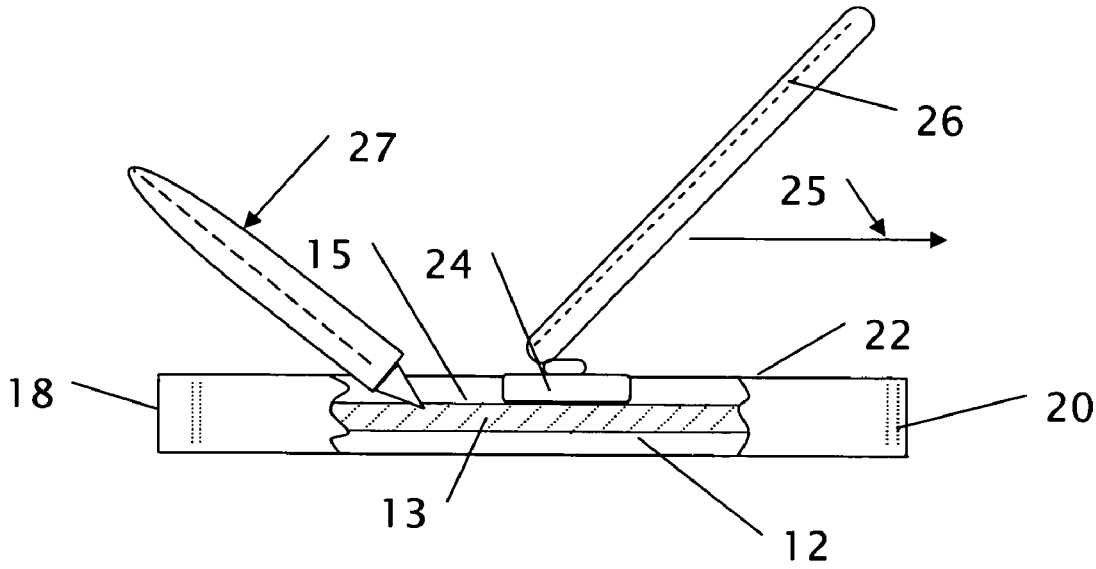
FIG. 2 is a side view of the multi-blade sharpening apparatus shown with a blade being sharpened.
Figure 3:
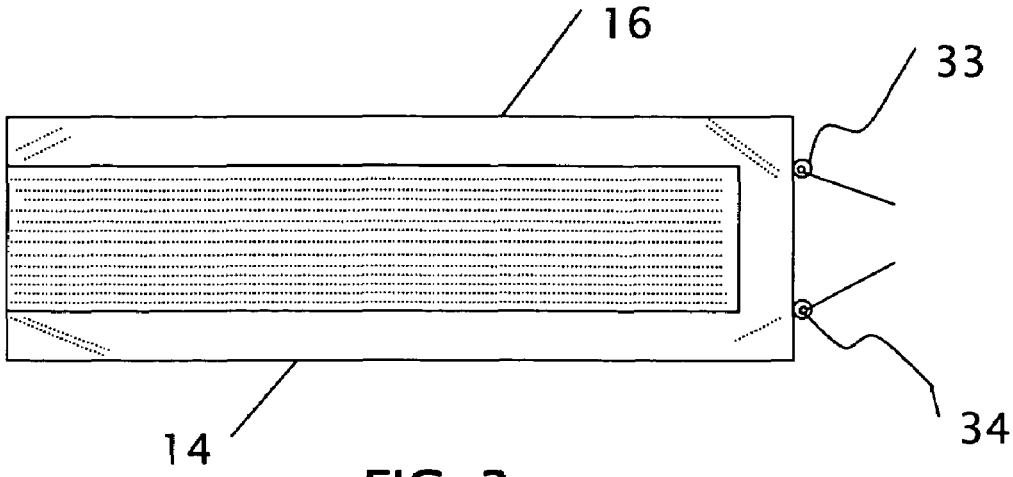
FIG. 3 is a top view of the multi-blade sharpening apparatus.

Referring to FIGS. 1 to 3, there is shown a honing device for a multi-bladed shaving cartridge. In this figure the housing 10 comprises a bottom wall 12, sidewalls 14 and 16, end wall 18, flushing wall 20 and top plate 22. Sharpening or honing element 13 as a substantially planar sharpening surface 15 secured to sidewalls 14 and 16, end walls 18, and bottom wall 12. In the embodiment shown only one end wall is shown to allow for flushing or cleaning of the surface 15. Recess 19 exists within the side wall and allows for engagement with ears on a sharpening sled that is shown and described in more detail in FIGS. 5-8. The configuration of the housing is shown as a flat substantially rectangular shape, but various other configurations of the housing are contemplated including square, triangular, round, elliptical and other shapes, as long as the housing allows for a honing surface that allows for the blades of a multi-bladed cartridge to be honed.

In the preferred embodiment the sharpening or honing element 13 is comprised of a smooth glass mirrored surface. Other honing elements are contemplated including diamond surfaces, metals, emery paper, sandpaper, stones, or other surfaces. In the preferred embodiment the honing or sharpening is flat, but the shape may be another shape that follows the contour of the blade that is being sharpened. It is further contemplated that the sharpening or honing element 13 has two sides, where one side is used for sharpening, and the opposite side is a mirror used for visual reflection. This allows a person to sharpen the blade(s) on one surface and view themselves while shaving with the other surface. This two sided embodiment allows for degradation of the reflective properties of the sharpening surface without compromising the reflective properties of the reflective surface. While it has been described that the two surfaces have different functions, the two sides can both be mirror surfaces providing twice the number of reflective and sharpening surfaces.

The material from which the housing 10 is made is not critical and it may suitably be made from a material such as steel or aluminum, wood, or it may be made from plastic. In the preferred embodiment, the housing is molded in a plastic material. The plastic material will not rust, is simple to manufacture and can be manufactured with high repeatability with minimal part cost.

Prior to sharpening, the sharpening process is facilitated by applying a thin coating of liquid soap or aloe Vera solution onto the surface 15 from a dispenser 27 as shown in FIG. 2. The aloe Vera or soap dispenser can be a variety of liquid dispensers that can be dry soap, liquid soap, aloe Vera, or a spray of a thin aloe Vera or soap and water solution. The multi-bladed cartridge razor may be honed or re-sharpened by placing the multi-bladed cartridge razor head within the housing 10 holding handle 26 so the cutting edges in the multi-bladed cartridge razor head is parallel to the sharpening or honing surface 13, and moving 25 the multi-bladed cartridge 24 along the surface 15 pulled toward the end 20. In this figure the lubricant dispenser is shown as a separate item it is contemplated that the dispenser is an integrated unit with the blade sharpening housing.

Figure 4:
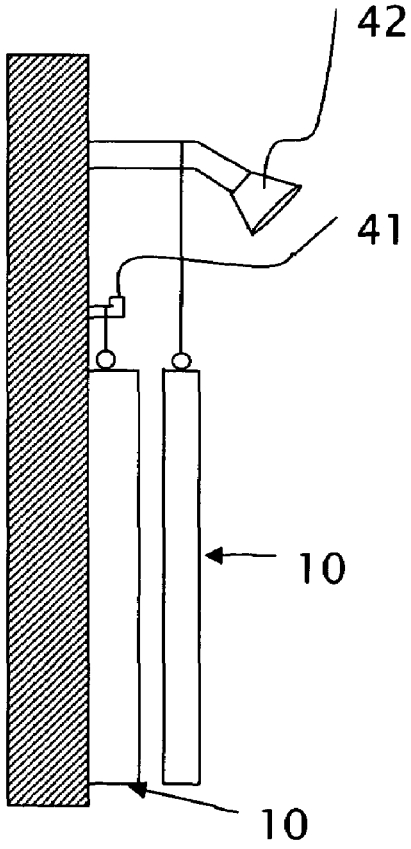
FIG. 4 is a side view of the multi-blade sharpening apparatus as it might hang within a shower.

Referring now to FIG. 4 that shows the blade-honing device on a wall mounted configuration attached to a wall-mounting holder 41 or showerhead 42 mounted methods. The mounting is accomplished with a string, or wire that is secured to one or two eyelet screw attachments 33 and 34 shown in FIG. 3. Wall mounting can be attached with a wall-mounting holder 41. The wall-mounting holder can be made of plastic or metal, and secured to a wall with adhesives or anchored to the wall with a screw or other fastener (not shown). The multi-bladed cartridge-honing device may have a hook or loop molded onto one or more sides for attachment or hooking the apparatus onto the head of a shower or the rail of a shower rod.

Figure 5:
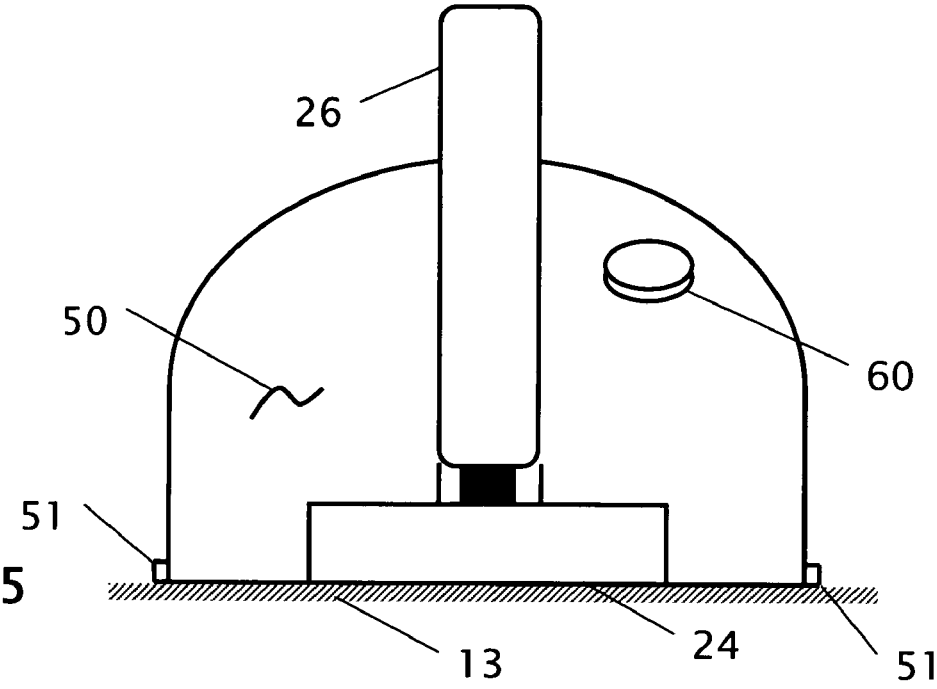
FIG. 5 is a front view of a multi-blade razor placed in the sharpening sled.

Referring now to FIG. 5 is a front view of a multi-blade razor 26 placed in the sharpening sled 50. In this figure a portion of the sharpening or honing element 13 is visible under the head 24 of the multi-blade razor 26. The optional guidance ears 51 are visible on the sides of the sharpening sled 50. The handle 26 is shown nested within the sharpening sled 50. In one embodiment the sharpening sled 50 is hollow and is used for both guiding the razor and dispensing aloe Vera or a soap and water solution to lubricate the multi-blade razor 26 on the sharpening or honing element 13. The filler cap 60 is shown where the lubrication solution is added to the inside of the sharpening sled 50.

Figure 6:
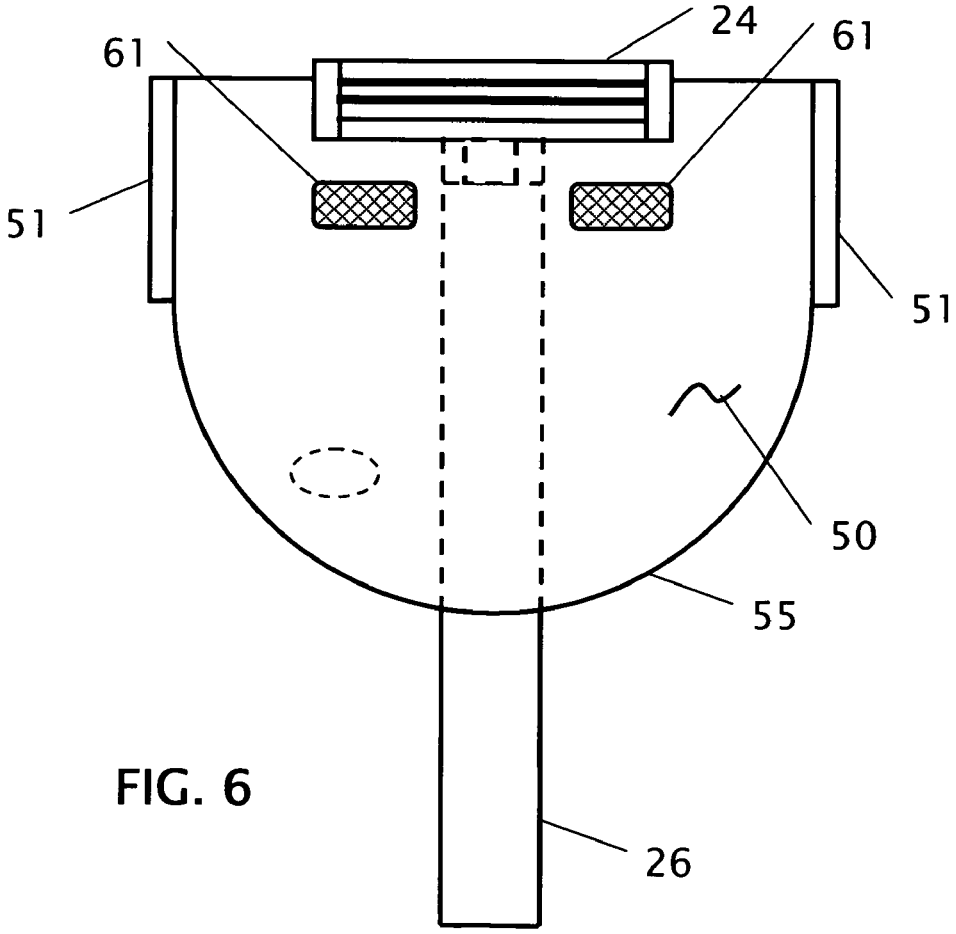
FIG. 6 is a bottom view of a multi-blade razor in the sharpening sled.

FIG. 6 is a bottom view of a multi-blade razor 26 in the sharpening sled 50. From this bottom view two lubrication dispensing ports 61 are visible. The dispensing port(s) 61 are a semi-porous material that only allows for a limited amount of lubricant fluid flow. The ports provide lubrication in front of the head 24 of the razor. The optional elongated guiding ears 51 are visible on the sides of the sharpening sled. These ears prevent the sharpening sled 50 from lifting or rocking as the razor is being moved across the sharpening or honing surface. Ears are shown on both sides of the sharpening sled 50 but it is also contemplated that the ears can exist only on one side of the sled or on neither side of the sled and the user slides the side of the sled along the edge of the sharpening surface to provide constrained movement. In this figure the back of the sharpening sled 50 is shown as being rounded 55. This rounded shape makes the sharpening sled smaller in size and it conforms easier to the shape of a user's hand. While a rounded shape is shown and described the actual shape can be varied without detracting from the function or use of the sharpening sled 50.

Figure 7:
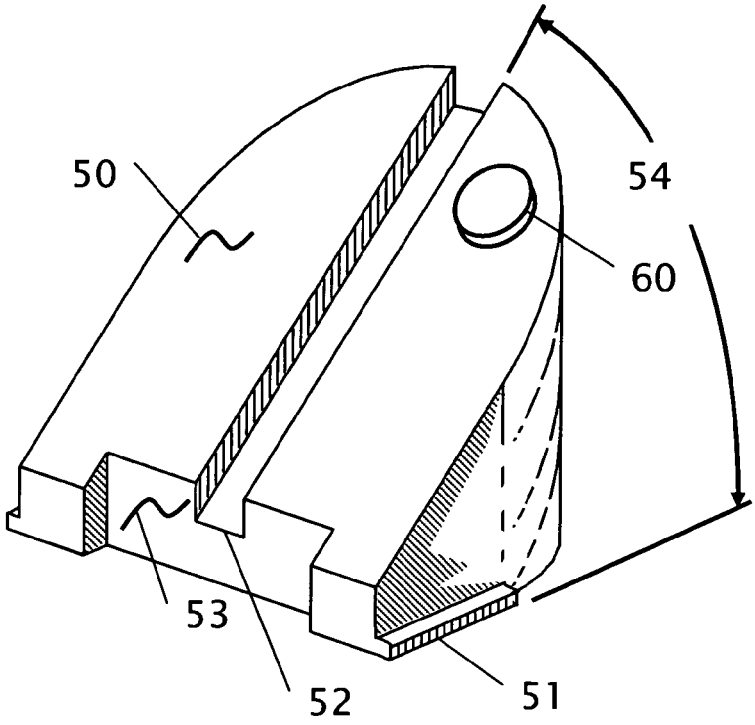
FIG. 7 is an isometric view of the sharpening sled.

FIG. 7 is an isometric view of the sharpening sled 50. From this isometric view the shape of the sharpening sled is more evident. It has an acute angle 54 that matches the shaving angle of a razor placed within the recess of the shaving sled where the handle of the razor is placed in recess 52 and the head of the razor is placed in recess 53 and one face of the razor is brought against the edge 56 of the sharpening sled 50. The acute angle 54 is created in a range of between 30 to 60 degrees depending upon the manufacturer of the razor and if the razor has a pivoting head. Prototypes have been made with an acute angle 54 of 40 degrees. The optional elongated guiding ears 51 are visible on the sides of the sharpening sled. These ears prevent the sharpening sled 50 from lifting or rocking as the razor is being moved across the sharpening or honing surface. The filler cap 60 is shown where the lubrication solution is added to the inside of the sharpening sled 50. It is also contemplated that the sharpening sled can be made from a transparent material for the operator to determine the amount of lubricant that is remaining within the sharpening sled 50. It is further contemplated that the sled is made from a semi flexible material to allow a user to squeeze the sides of the sharpening sled 50 to expel some lubricant out of the dispensing port(s) 61.

Figure 8:
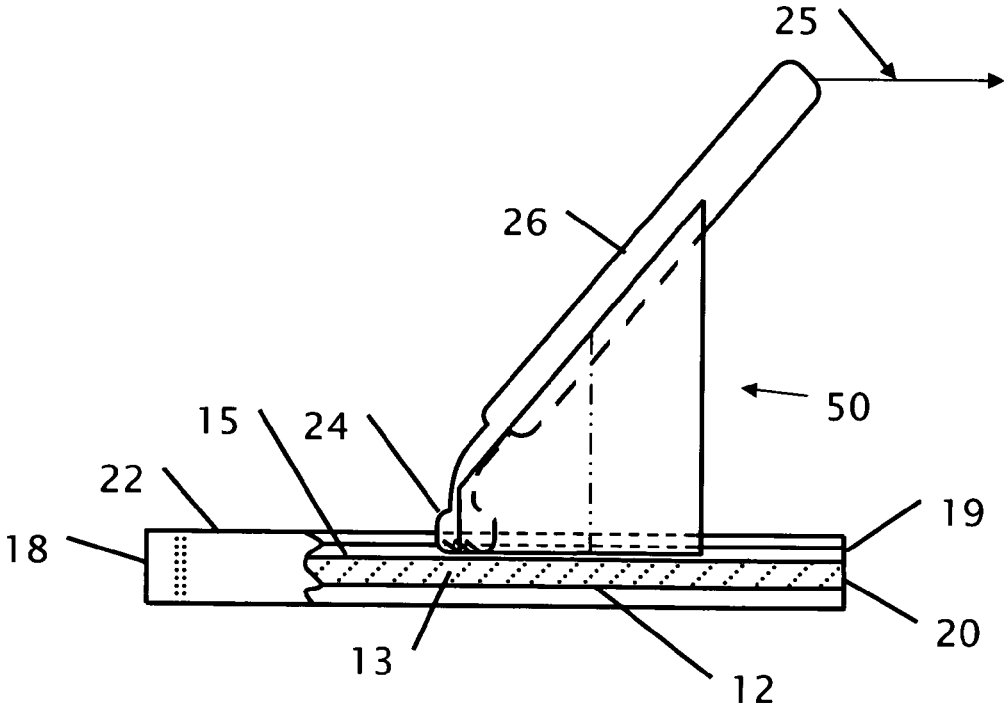
FIG. 8 is a side sectional view of the multi-blade sharpening apparatus shown with a blade on the sled being sharpened.

FIG. 8 is a side sectional view of the multi-blade sharpening apparatus shown with a blade on the sled 50 being sharpened. By using the sharpening sled all the blades in the head of the multi-bladed razor 24 are uniformly sharpened as a single unit to ensure uniformity and consistency of the blades for optimal razor blades(s) sharpness. The bottom wall 12, the top plate 22, the sharpening or honing element 13, the substantially planar sharpening surface 15, the end wall 18 are described in more detail with FIGS. 1 and 2. The recess 19 is visible in this view. The recess 19 allows for engagement of optional ears (not shown 51) on the sharpening sled 50. The flushing wall 20 allows debris, and lubricant to be flushed from the sharpening or honing surface 13 to provide a consistent honing surface without a build-up of removed material. The multi-bladed cartridge razor may be honed or resharpened by placing the multi-bladed cartridge razor head within the housing 10 holding handle 26 so the cutting edges in the multi-bladed cartridge razor head within the sharpening sled 50 and moving 25.

Thus, specific embodiments and applications for a multi-blade sharpening apparatus have been disclosed. It should be apparent, however, to those skilled in the art that many more modifications besides those described are possible without departing from the inventive concepts herein. The inventive subject matter, therefore, is not to be restricted except in the spirit of the appended claims

What is claimed is:

1. Apparatus for sharpening the cutting edges of a multi-bladed cartridge razor comprising:

an elongated, substantially flat bottom member, said flat bottom member having a top, bottom, and is secured to sidewalls and at least one end wall with a peripheral raised side edge extending around the flat bottom member to provide constrained movement of a multi-bladed cartridge razor head;

a razor sled for nesting a handle of the multi-bladed cartridge razor head wherein the razor sled has an acute angle that matches a shaving angle of the multi-bladed cartridge razor and the razor sled has side surfaces that engage on the peripheral raised side edge to allow for constrained movement of a multi-bladed cartridge razor head;

the razor sled is a reservoir for aloe Vera solution and further includes at least one dispensing port on the bottom of the razor sled;

an exposed glass sharpening member being mounted within the housing having a sharpening surface for sharpening a multi-bladed cartridge razor positioned to be engaged by the cutting edges of said multi-bladed cartridge razor head during said movement of said multi-bladed cartridge head and said razor sled along said sharpening surface; and a dispensing device for dispensing aloe Vera solution on the said sharpening member that provides lubrication to assist in the honing process.

2. The apparatus from claim 1, wherein the acute angle is between 30 degrees and 60 degrees.

3. The apparatus from claim 1 wherein the sharpening member is substantially flat or contoured to match the shape of the blade.

4. The apparatus from claim 1 wherein the movement consists of one or more longitudinal movements of the multi-bladed cartridge on the sharpening surface.

5. The apparatus from claim 1 wherein the movement consists of at least one non-linear stroke.

6. The apparatus from claim 1 wherein the razor sled further includes elongated ears for engagement in elongated recess on the peripherally raised sidewalls to reduce angular lifting and rotation of the razor sled on the sharpening surface.

7. The apparatus from claim 1 wherein the aloe Vera is a gel consistency.

8. The apparatus according to claim 1 wherein the substantially exposed glass sharpening member is a mirror whereby the sharpening surface can be used both to sharpen the multi-bladed cartridge razor and as a mirror to aid is viewing oneself while shaving.

9. The apparatus according to claim 1 wherein the razor sled further includes a first recess for the handle of the multi-cartridge razor and a second recess for the multi-bladed razor head.

10. Apparatus for sharpening the cutting edges of a multi-bladed cartridge razor comprising:

An elongated glass sharpening member having a sharpening surface for sharpening a multi-bladed cartridge razor positioned to be engaged by the cutting edges of a multi-bladed cartridge razor during said movement of said multi-bladed cartridge along said sharpening surface; and a razor sled that slides on the sharpening surface and dispenses aloe Vera gel or soap and water solution onto the sharpening surface while the multi-bladed cartridge razor and the razor sled is being moved over the sharpening surface to provide a lubricant to assist in the sharpening process.

11. The apparatus from claim 10 wherein the sharpening member is a mirror.

12. The apparatus from claim 10 wherein the sharpening member is substantially flat or contoured to match the shape of the blade.

13. The apparatus claim 10 wherein the engagement consists of one or more strokes on the glass sharpening member.

14. The apparatus from claim 10 wherein the razor sled further includes engaging means that engage with the glass sharpening member for constrained movement of the razor sled on the glass sharpening member.

15. The apparatus according to claim 10 wherein the substantially exposed glass sharpening member is a mirror whereby the sharpening surface can be used both to sharpen the multi-bladed cartridge razor and as a mirror to aid is viewing oneself while shaving.

16. The apparatus according to claim 10 wherein the razor sled further includes a first recess for the handle of the multi-cartridge razor and a second recess for the multi-bladed razor head.

17. The apparatus according to claim 10 wherein the razor sled has a reservoir for aloe Vera or a soap and water solution and further includes at least one dispensing port on the bottom of the razor sled.

18. The apparatus according to claim 10 wherein the top surface with and acute angle of between 30 and 60 degrees that matches the shaving angle of the multi-bladed cartridge razor.

19. Apparatus for sharpening the cutting edges of a multi-bladed cartridge razor comprising:

an elongated, substantially flat bottom member, said flat bottom member having a top, bottom, and is secured to sidewalls and at least one end wall with a peripheral raised side edge extending around the flat bottom member to provide constrained movement of a multi-bladed cartridge razor head;

a razor sled for nesting a handle of the multi-bladed cartridge razor head wherein the razor sled has an acute angle that matches a shaving angle of the multi-bladed cartridge razor and the razor sled has side surfaces that engage on the peripheral raised side edge to allow for constrained movement of a multi-bladed cartridge razor head;

the razor sled further includes a first recess for the handle of the multi-cartridge razor and a second recess for the multi-bladed razor head;

an exposed glass sharpening member being mounted within the housing having a sharpening surface for sharpening a multi-bladed cartridge razor positioned to be engaged by the cutting edges of said multi-bladed cartridge razor head during said movement of said multi-bladed cartridge head and said razor sled along said sharpening surface; and a dispensing device for dispensing aloe Vera solution on the said sharpening member that provides lubrication to assist in the honing process.

* * * * *